US007215078B2

(12) United States Patent
Sano et al.

(10) Patent No.: US 7,215,078 B2
(45) **Date of Patent: *May 8, 2007**

(54) PLASMA DISPLAY APPARATUS TO IMPROVE EFFICIENCY OF EMISSION LIGHT

(75) Inventors: Ko Sano, Tokyo (JP); Kazutoshi Morikawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 198 days.

This patent is subject to a terminal disclaimer.

(21) Appl. No.: 10/962,584

(22) Filed: Oct. 13, 2004

(65) Prior Publication Data

US 2005/0062420 A1 Mar. 24, 2005

Related U.S. Application Data

(62) Division of application No. 09/816,328, filed on Mar. 26, 2001, now Pat. No. 6,870,316.

(30) Foreign Application Priority Data

Mar. 28, 2000 (JP) ..... 2000-088064
Dec. 27, 2000 (JP) ..... 2000-397383

(51) Int. Cl.
*H01J 17/49* (2006.01)

(52) U.S. Cl. ..... 313/583; 313/586; 313/582; 313/584

(58) Field of Classification Search ..... 313/583
See application file for complete search history.

(56) References Cited

U.S. PATENT DOCUMENTS 5,640,068 A 6/1997 Amemiya (Continued)

FOREIGN PATENT DOCUMENTS

JP 7-288087 A 10/1995

(Continued)

OTHER PUBLICATIONS

Proceedings of IDW'99, p. 599, "A High Performance Delta Arrangement Cell PDP with Meander Barrier Ribs," O. Toyoda et al.

(Continued)

*Primary Examiner*—Nimeshkumar D. Patel
*Assistant Examiner*—Peter Macchiarolo
(74) *Attorney, Agent, or Firm*—Birch, Stewart, Kolasch & Birch, LLP

(57) ABSTRACT

A plasma display apparatus includes a plurality of display element electrodes each constituted of a pair of electrode segments having linear edges opposing each other, with a predetermined distance provided therebetween, the width of each of the electrode segments becoming narrower in the direction away from the associated one of the linear edges. The plasma display apparatus also includes a barrier structure, the inner surfaces of which being disposed along the outer ends of the plurality of display element electrodes and thereby defining a plurality of cells each of which is to be activated by the associated one of the plurality of display element electrodes so as to emit light. In the plasma display apparatus, ultraviolet rays caused by a discharge are efficiently transmitted to phosphor members on the surfaces of cells to emit light with a reduced loss of energy.

10 Claims, 16 Drawing Sheets

U.S. PATENT DOCUMENTS

| | | | | |
|---|---|---|---|---|
| 5,825,128 | A | 10/1998 | Betsui et al. | |
| 5,967,872 | A * | 10/1999 | Betsui et al. | 445/24 |
| 5,972,528 | A | 10/1999 | Kim | |
| 6,376,986 | B1 * | 4/2002 | Takagi et al. | 313/582 |
| 6,512,337 | B2 * | 1/2003 | Hirano et al. | 315/169.4 |
| 6,522,072 | B1 * | 2/2003 | Yura et al. | 313/582 |
| 6,646,377 | B2 * | 11/2003 | Hashimoto | 313/582 |
| 6,841,928 | B2 * | 1/2005 | Kang | 313/483 |
| 6,870,316 | B2 * | 3/2005 | Sano et al. | 313/583 |
| 2002/0003405 | A1 * | 1/2002 | Kang | 313/586 |
| 2002/0008474 | A1 * | 1/2002 | Kurogi et al. | 313/584 |
| 2002/0021090 | A1 * | 2/2002 | Sano et al. | 313/587 |
| 2004/0135507 | A1 * | 7/2004 | Park et al. | 313/582 |
| 2005/0029939 | A1 * | 2/2005 | Woo et al. | 313/582 |
| 2005/0029941 | A1 * | 2/2005 | Kwon et al. | 313/582 |
| 2005/0029945 | A1 * | 2/2005 | Hwang | 313/583 |
| 2005/0067958 | A1 * | 3/2005 | Woo et al. | 313/582 |
| 2005/0242728 | A1 * | 11/2005 | Song et al. | 313/583 |

FOREIGN PATENT DOCUMENTS

| | | | |
|---|---|---|---|
| JP | 2962039 | B2 | 10/1998 |
| JP | 11-096921 | A | 4/1999 |
| JP | 2000-223033 | A | 8/2000 |

OTHER PUBLICATIONS

"Improvement of Luminance and Luminous Efficiency of Surface-Discharge Color ac PDP", T. Shinoda, et al., SID 91 DIGEST, pp. 724-727.

* cited by examiner

PLASMA DISPLAY APPARATUS TO IMPROVE EFFICIENCY OF EMISSION LIGHT

This Nonprovisional application is a divisional of and claims priority under 35 U.S.C. § 120 to U.S. patent application Ser. No. 09/816,328, filed in the United States Patent and Trademark Office on Mar. 26, 2001, now U.S. Pat. No. 6,870,316, which claims priority under 35 U.S.C. § 119(a)–(d) to Japanese Patent Application No. 2000-088064, filed in Japan on Mar. 28, 2000 and Japanese Patent Application No. 2000-397383, filed in Japan on Dec. 27, 2000, the entire contents of all of these applications are hereby incorporated by reference.

BACKGROUND OF THE INVENTION

1. Field of the Invention

The present invention generally relates to plasma display apparatuses, and more specifically, the present invention relates to a plasma display apparatus in which the efficiency of emission of light is improved.

2. Description of the Related Art

FIG. 1 is an exploded perspective view showing the construction of an AC plasma display panel (hereinafter abbreviated as PDP) disclosed in U.S. Pat. No. 5,640,068. Referring to FIG. 1, the PDP includes a plurality of display electrodes, only one of which is shown and is indicated by the reference numeral 141. The display electrode 141 extends in the row direction of the PDP. The display electrode 141 is constituted of a pair of electrodes X and Y having edges opposing each other. The display electrode 141 is formed on a front substrate 11, and is covered by a dielectric layer 17. The surface of the dielectric layer 17 is covered by a protective MgO film. The PDP also includes linear-shaped barrier ribs 129 extending in the column direction of the PDP. The height of the barrier ribs is usually on the order of 100 to 150 μm. The inner faces of the bulkheads 129 are coated with a phosphor member 28. The PDP further includes a plurality of address electrodes 22 to perform address discharge on the X electrode of the display electrode 141. The barrier ribs 129 and the address electrodes 22 are formed on a back substrate 21. Within the PDP, mixture of ionizable gases, such as xenon, neon, and helium, is sealed. The mixed gas is used to cause discharge and thereby generating ultraviolet rays, which excite the phosphor member 28 to cause emission.

In operation, first, a voltage higher than the breakdown voltage is applied between the X electrode of the display electrode 141 and the address electrodes 22 to cause an address discharge. At this time, a temporary discharge occurs between the electrodes X and Y, generating a charge on the surfaces of the electrodes X and Y. The charges generated on the surfaces of the electrodes X and Y due to the address discharge is referred to as a wall charge. After the address discharge, a pulse voltage lower than the breakdown voltage is applied between the electrodes X and Y of the display electrode 141; then, a discharge occurs between the electrodes X and Y of the display electrode 141 due to the wall charge generated by the address discharge. The discharge between the electrodes X and Y is called a sustaining discharge, which occurs only in the region where a wall charge is generated due to the address discharge. The sustaining discharge emits ultraviolet rays that excite the phosphor member 28 to cause luminescence.

FIG. 2 is an exploded perspective view showing the configuration of a PDP disclosed in U.S. Pat. No. 5,825,128.

The PDP shown in FIG. 2 has meandering barrier ribs 129. Separation of discharge areas by the meandering barrier ribs 129 serves to enhance resolution of the PDP. Each of the areas separated by the barrier ribs 129 is generally called a cell.

The conventional PDPs with the constructions shown in FIGS. 1 and 2 have the following problems.

FIGS. 3A and 3B are schematic diagrams illustrating a state of discharge caused by the display electrodes 141 of the conventional PDPs shown in FIGS. 1 and 2. The problems of the conventional PDPs will be described with reference to FIGS. 3A and 3B. As shown in FIGS. 3A and 3B, a discharge produced in a gap (g) between the X and Y electrodes spreads in a direction away from the discharge gap (g), maintaining a circular or an elliptical shape, and terminates by reaching an inner surface of the barrier ribs 129. The energy of the discharge terminated by the inner surface of the barrier ribs 129 is dissipated as thermal energy without generating ultraviolet rays that excite the phosphor 28 to cause luminescence. The conventional PDP shown in FIG. 2, has the display electrode 141 formed continuously over multiple cells arranged in the row direction; thus, discharge spreads beyond a range of a single cell, as shown in FIG. 3A. This means the discharge is terminated by the inner surfaces of the barrier ribs 129 without causing the phosphor 28 to emit light.

On the other hand, the conventional PDP shown in FIG. 1, has continuous cells in the column direction; thus, discharge spreads beyond a range of single cell, as shown in FIG. 3B. This means the propagation loss of the ultraviolet rays emitted by discharge becomes greater as the energy propagates away from the discharge gap g in the column direction until reaching the surface of the phosphor 28. This is more prominent at the anode side, at which progression of discharge is smaller.

PDPs generate ultraviolet rays by discharging, and excite the phosphor 28 by the ultraviolet rays to cause emission of light. Therefor, the energy loss caused in that two processes must be minimized to produce luminescence efficiently.

The conventional PDPs have another problem caused by an electric field formed around the address electrode 22 disposed in the center of the cells, and this electric field disturbs the sustaining discharge generated by display electrode 141. The below further describes this problem. Because the address electrode 22 is composed of a conductive material such as metal, an intense electric field is formed around the address electrode 22 due to the electric field formed between the X and Y electrodes during a sustaining discharge. By way of example, if the pulse voltage for sustaining discharge is 180 V, the address electrode 22 is at a voltage between 180 V and 0 V, for example, 65 V, in which case voltage differences of 115 V and 65 V occurs between the address electrode 22 and the X and Y electrodes of the display electrodes 141, respectively, forming an intense electric field. FIG. 4A shows a distribution of electric field where the address electrode 22 is not disposed, and FIG. 4B shows a distribution of electric field where a voltage of 65 V is generated on the address electrode 22. FIG. 5A shows a discharge area corresponding to the distribution of electric field shown in FIG. 4A, in which the discharge is concentrated within the discharge gap g. FIG. 5B shows a discharge area corresponding to the distribution of electric field shown in FIG. 4B, in which the discharge extends over a large area, causing loss of discharge energy at the barrier ribs 129.

In PDPs, loss of discharge energy is a significant factor for power consumption. In the conventional PDPs, the display electrode 141, the barrier ribs 129, and the address electrode 22 are not configured so that the phosphor 28 emits light efficiently, resulting in necessity of high power supply.

It is therefor, a primary object of the invention to provide a plasma display apparatus that is able to emit high light with low energy supply.

SUMMARY OF THE INVENTION

This object is achieved in accordance with one aspect of the present invention which is a plasma display apparatus comprising a front and back substrates opposing each other. A plurality of display element electrodes each constituted of a pair of electrode segments is formed on the front substrate. The pair of electrode segments has linear edges opposing each other, and the width of each of the electrode segments becoming narrower in the direction away from the linear edges. A barrier structure having the inner surfaces disposed along the outer ends of the plurality of display element electrodes is formed on the back substrate. The barrier structure defines a plurality of cells each of which is activated by the associated one of the plurality of display element electrodes.

In another aspect of the present invention is a plasma display apparatus comprising a front and back substrates opposing each other. A plurality of display element electrodes each constituted of a pair of rectangular electrode segments is formed on the front substrate. A barrier structure having the inner surfaces disposed along the outer ends of the plurality of display element electrodes is formed on the back substrate. The barrier structure defines a plurality of cells each of which is activated by the associated one of the plurality of display element electrodes.

DESCRIPTION OF THE PREFERRED EMBODIMENTS

First Embodiment

Figure 6A:
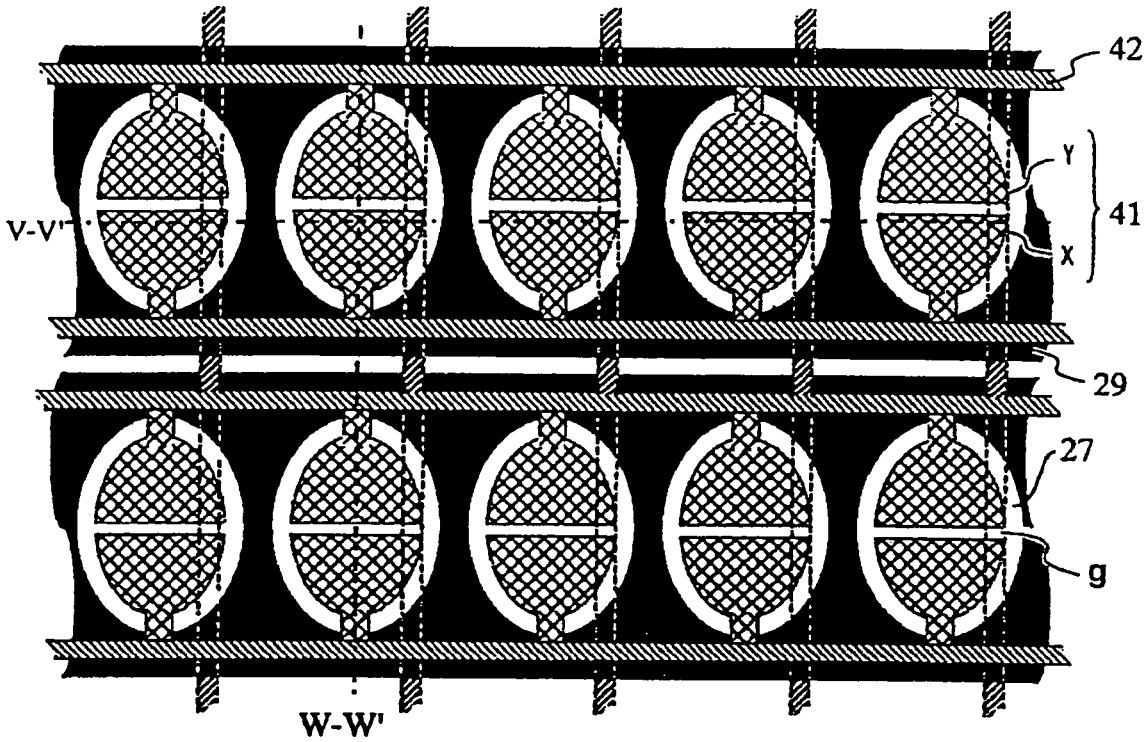
FIG. 6A is a top partial view of a plasma display apparatus according to a first embodiment of the present invention.
Figure 6B:
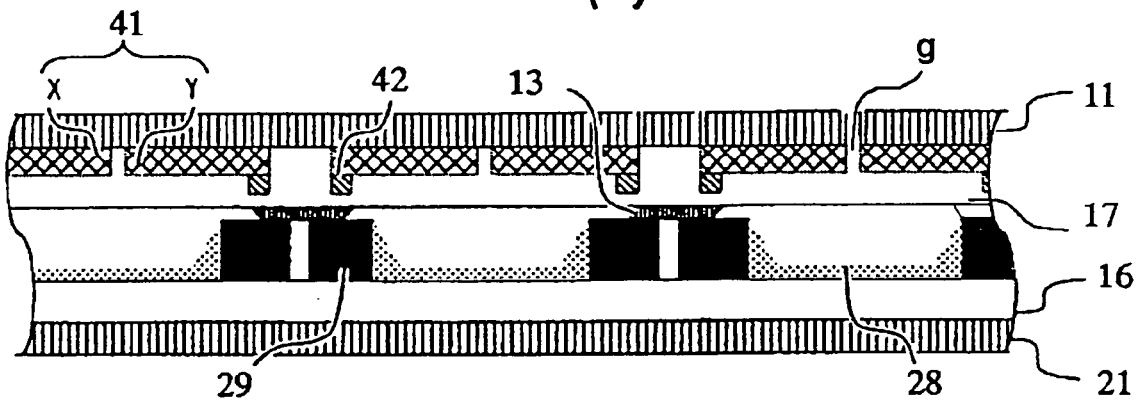
FIGS. 6B and 6C are sectional views taken along the lines W–W' and V–V' in FIG. 6A, respectively.
Figure 6C:
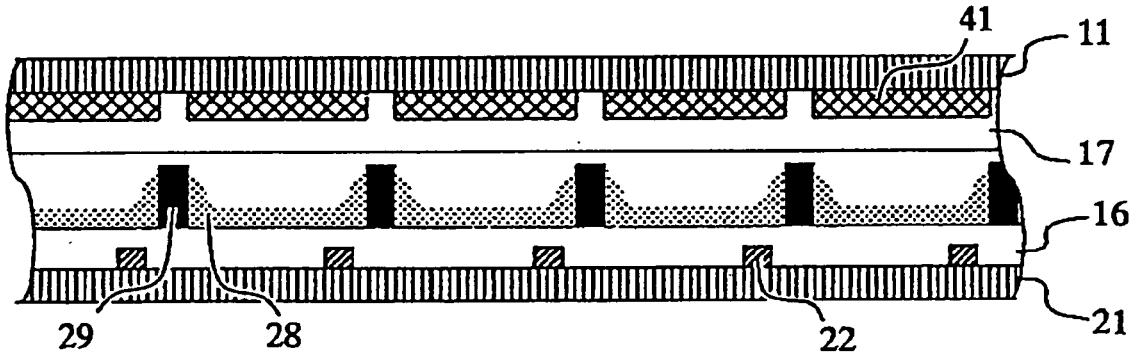

FIG. 6A is a top view showing in part the construction of a PDP according to a first embodiment of the present invention, and FIGS. 6B and 6C are sectional views taken along, respectively, the lines W–W' and V–V' of FIG. 6A.

Referring to FIGS. 6A, 6B, and 6C, the PDP includes a plurality of display element electrodes, one of which is indicated by the reference numeral 41. The display element electrode 41 is constituted of a pair of semicircular or semielliptical electrode segments X and Y, and is formed in a shape similar to the shape of a discharge area. The display element electrode 41 serves to cause a discharge in the associated one of a plurality of cells 27 defined by a barrier structure 29. The inner surface of the barrier structure 29 is coated with a phosphor member 28 which cause luminescence in response to a discharge of the display element electrode 41. The PDP also includes a plurality of address electrodes, one of which is indicated by the reference numeral 22. The address electrode 22 is disposed along one side of the cell in the associated column. The PDP also includes a plurality of bus electrodes, one of which is indicated by the reference numeral 42. The bus electrode 42 serves to apply a voltage to the display element electrodes in the associated row. The display element electrodes 41 and the bus electrodes 42 are formed on a front substrate 11, and are covered by a dielectric layer 17. The address electrodes 22 are formed on a back substrate 21, and are covered by a overglazing layer 16, composed of a white dielectric material, which reflects light emitted by the phosphor member 28. The top surface of the barrier structure 29 is formed in black so as to achieve a good contrast. On the dielectric layer 17, there are provided a plurality of spacer layers, one of which is indicated by the reference numeral 13, so as to prevent excessive progress of discharges and for enhancing the priming effect.

Figure 1:
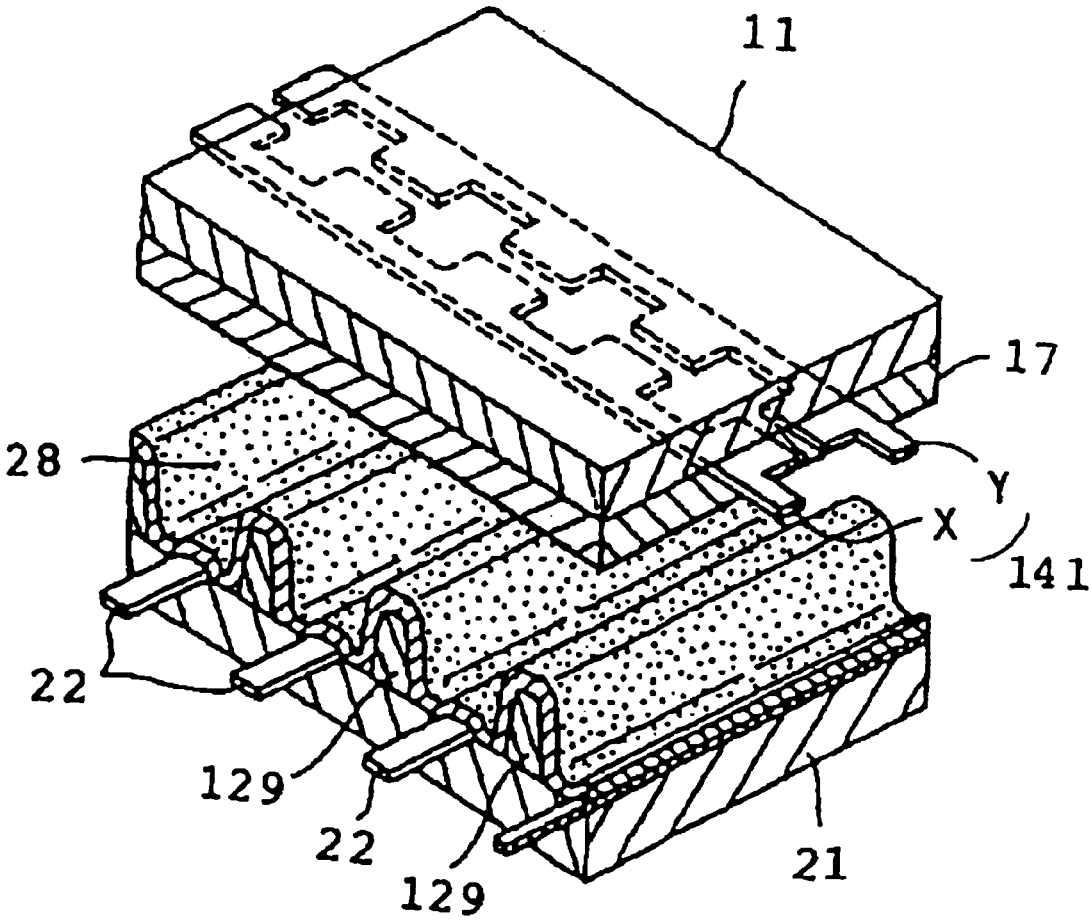
FIG. 1 PRIOR ART
FIG. 1 is an exploded perspective view showing the construction of a plasma display apparatus disclosed in U.S. Pat. No. 5,640,068.
Figure 2:
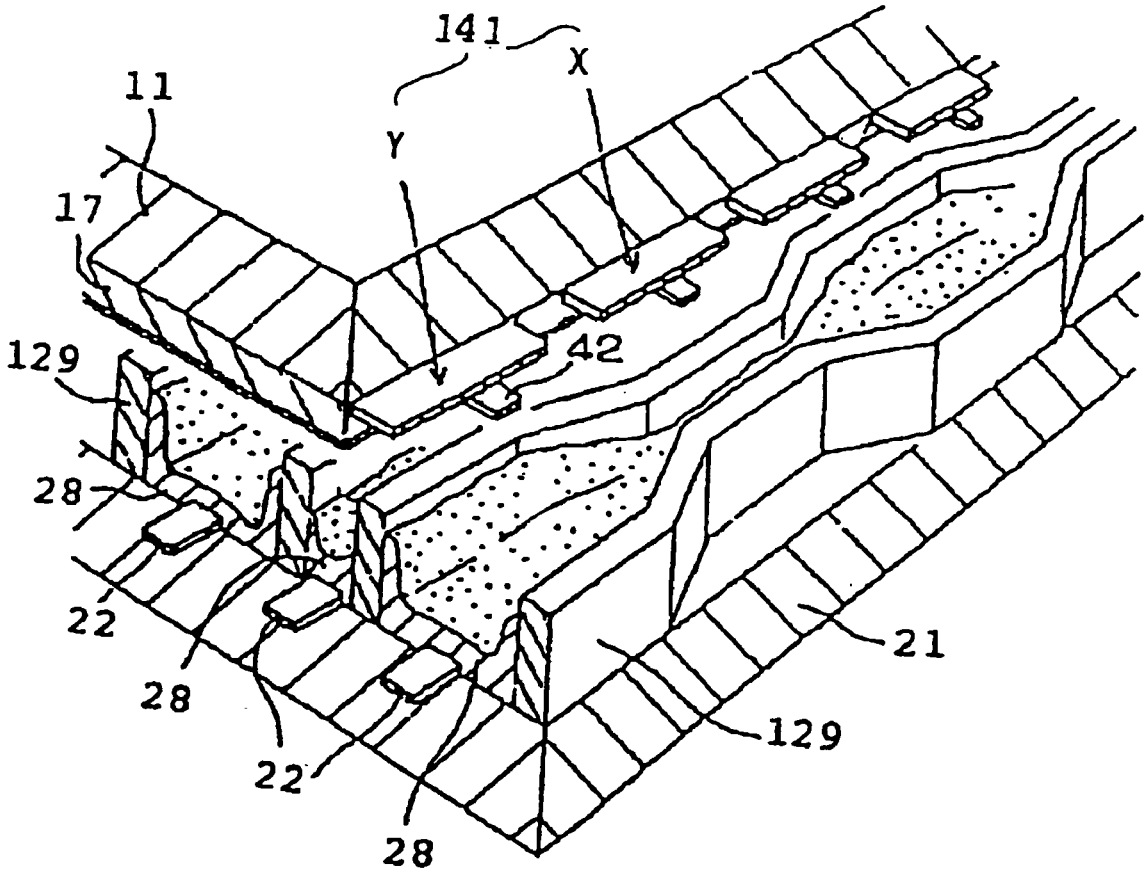
FIG. 2 PRIOR ART
FIG. 2 is an exploded perspective view showing the construction of a plasma display apparatus disclosed in U.S. Pat. No. 5,825,128.
Figure 3A:
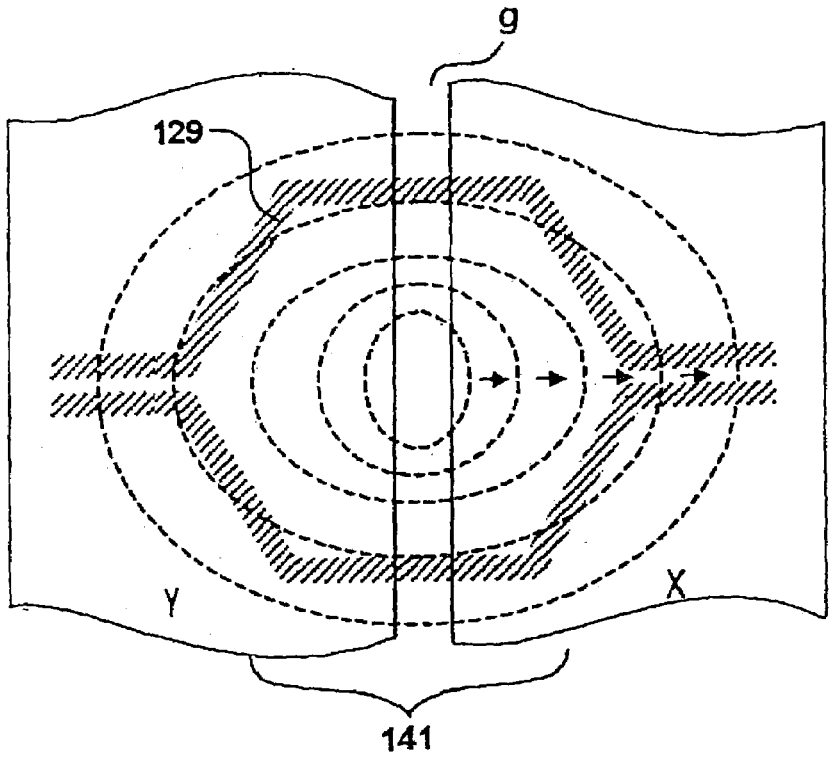
PRIOR ART FIG. 3(a)
FIGS. 3A and 3B are schematic diagrams each illustrating a discharge generated at the surface of a display electrode, in the plasma display apparatuses shown respectively in FIG. 2 and FIG. 1.
Figure 3B:
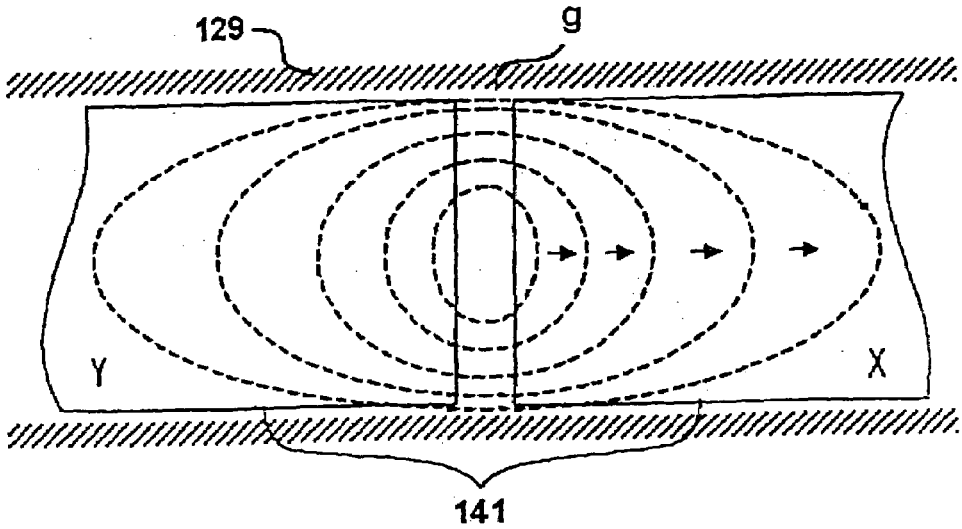
PRIOR ART FIG. 3(b)
Figure 4A:
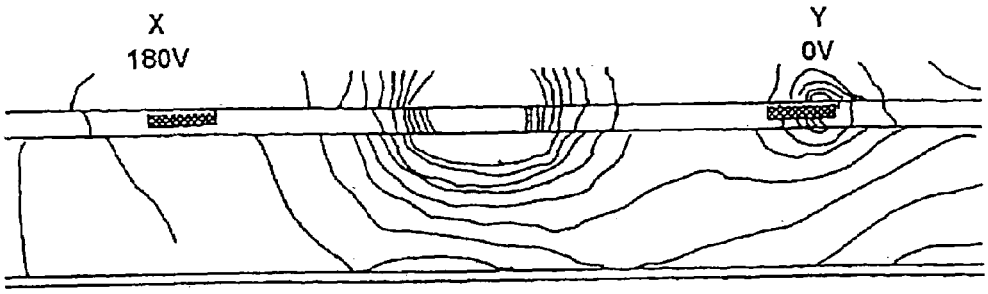
PRIOR ART FIG. 4(a)
FIGS. 4A and 4B are schematic diagrams each illustrating a distribution of electric field in a conventional plasma display apparatus, respectively at positions where an address electrode is not disposed and where an address electrode is disposed.
Figure 4B:
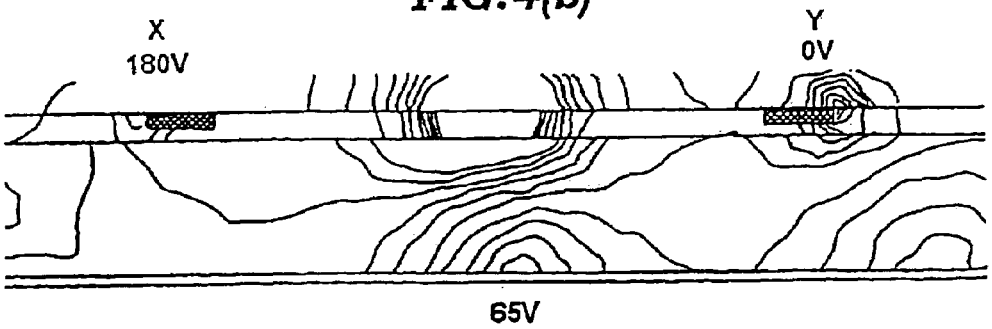
PRIOR ART FIG. 4(b)
Figure 5A:
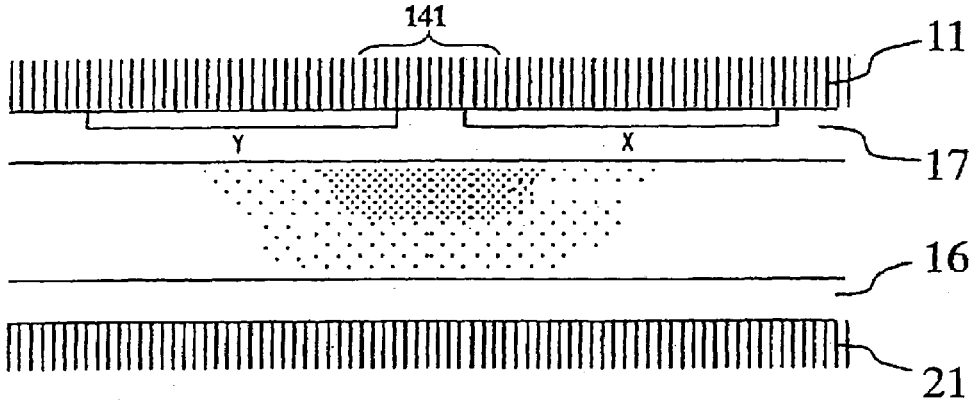
PRIOR ART FIG. 5(a)
FIGS. 5A and 5B are schematic diagrams each illustrating discharge areas corresponding to the distributions of electric field shown respectively in FIGS. 4A and 4B.
Figure 5B:
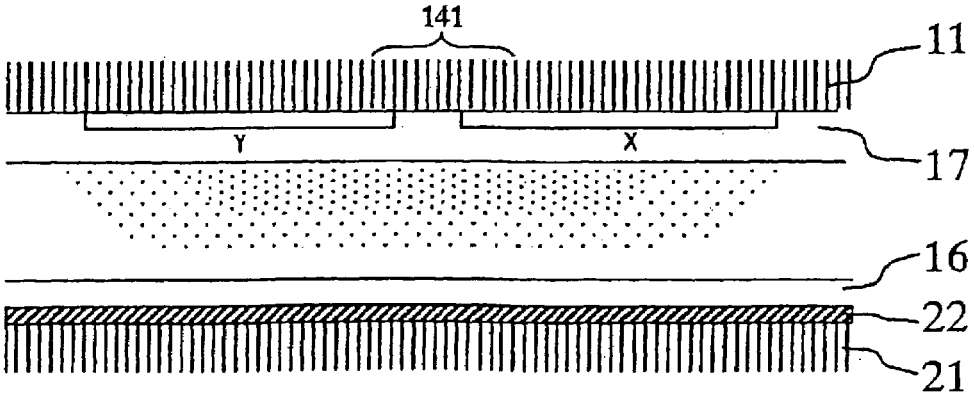
PRIOR ART FIG. 5(b)

A discharge generated in a discharge gap g between the electrode segments X and Y spreads on the surface of the display element electrode 41 and terminates at the outer end of the display element electrode 41, before it reaches to the inner surfaces of the barrier structure 29. The inner surfaces of the barrier structure 29 is formed along the outer end of the display element electrode 41 at which the discharge terminates, therefore ultraviolet rays generated by the discharge efficiently impinge on the phosphor member 28 to cause luminescence. Accordingly, the discharge energy is prevented from being dissipated, as thermal energy at the barrier structure 29, thereby enhancing the efficiency of emission of light. Furthermore, the address electrode 22 is disposed along one side of cells 27 in the associated row to prevented undesired effect to the discharge caused by an electric field formed around the address electrode 22. Accordingly, the discharge is concentrated at the discharge gap g of the display element electrode 41, as shown in FIG. 5A, which serves to provide a high efficiency of emission of light. In accordance with the above construction, a weak electric field is formed in the proximity of the inner surface of the barrier structure 29, coated with the phosphor member 28, enhancing the efficiency of ultraviolet radiation and thereby enhancing the efficiency of emission of light.

Figure 7:
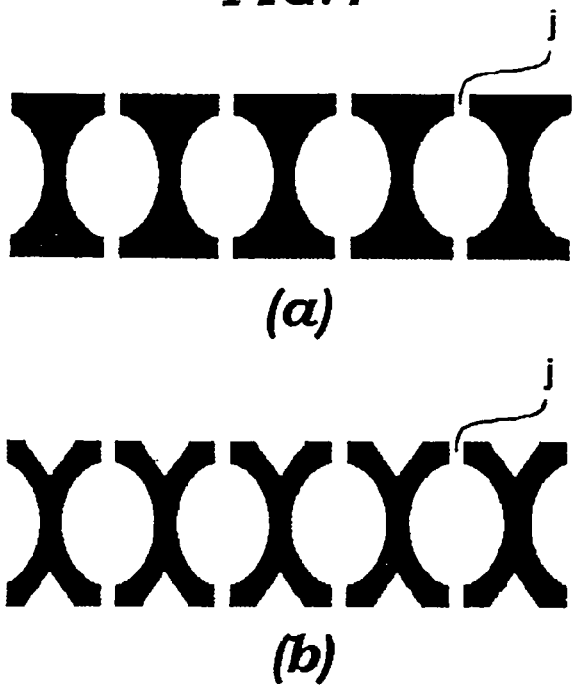
FIGS. 7A and 7B are top partial views showing modifications of a barrier structure in the first embodiment.
Figure 8:
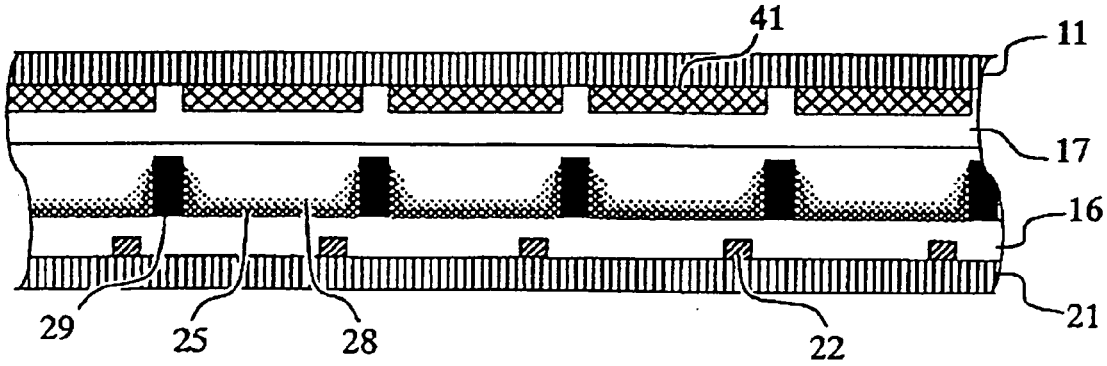
FIG. 8 is a sectional view showing a modification of the plasma display apparatus according to the first embodiment, in which a reflecting layer is incorporated.

FIGS. 7A and 7B are top views showing modifications of the barrier structure 29. In the modifications, the barrier structure 29 is provided with openings j, facilitating the evacuation process. FIG. 8 shows a modification in which a reflecting layer 25 is provided under the phosphor member 28 of the cell 27. The reflecting layer 25 serves to reflect light going into overglazing layer 16 or the barrier structure 29. The reflecting layer 25 may be formed, for example, by screen printing, using white particles of oxides such as magnesium oxide, titanium oxide, aluminum oxide, and zinc oxide.

It is to be appreciated that because the actual shape of the discharge area may vary depending on the pressure and composition of the gas, the dimensions and specific shapes of the display element electrodes should be determined in accordance therewith. For example, the display element electrode 41 may be constituted of a pair of triangular electrode segments while the cell 27 being defined in a rhombus shape along the outer end of the display element electrode 41. Alternatively, it is equally advantageous when the display element electrode 41 is constituted of a pair of electrodes having the shape of a polygon such as a hexagon or an octagon while the cell 27 being defined along the outer end of the display element electrode 41.

Second Embodiment

Figure 10:
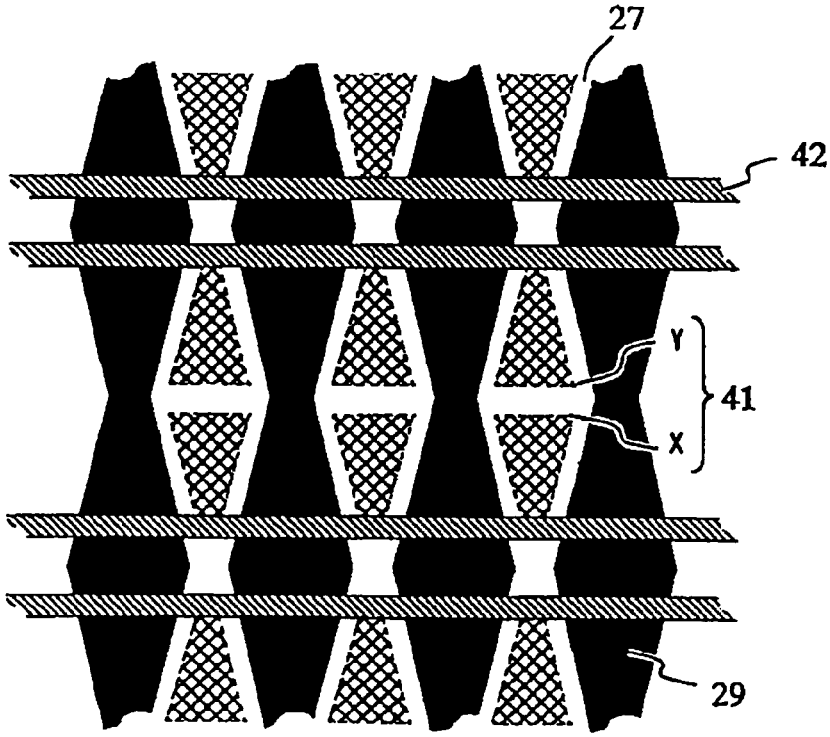
FIG. 10 is a top partial view of a plasma display apparatus according to a second embodiment of the present invention.

FIG. 10 is a top view showing in part the construction of a PDP according to a second embodiment of the present invention. As shown in FIG. 10, the PDP according to the second embodiment has display element electrodes 41 constituted of a pair of trapezoidal electrodes and the barrier structure 29 of which width is varied in accordance with the shapes of the display element electrodes. The barrier structure 29 defines cells 27 having channel in the column direction. The channel passing through each of the cells 27 in the column direction facilitates the evacuation process to introduce ionizable gas in between the front substrate 11 and the back substrate 21.

Third Embodiment

Figure 11:
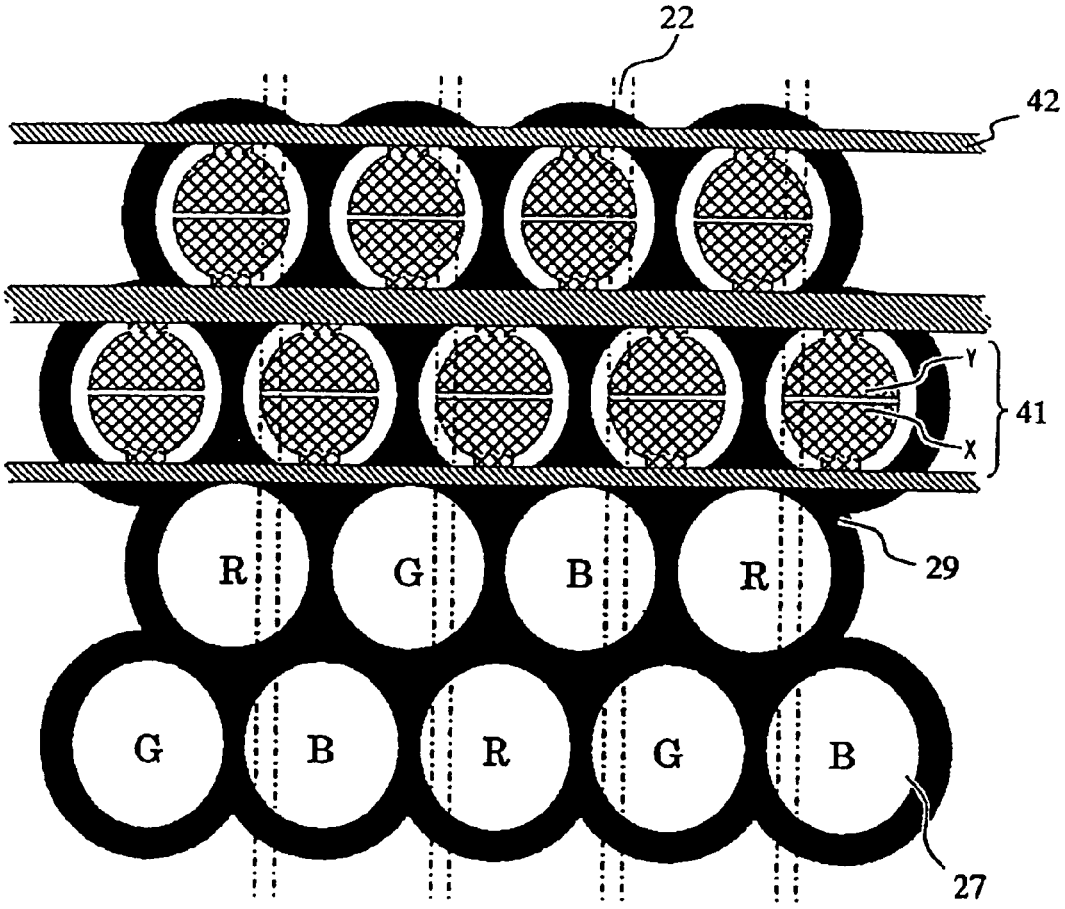
FIG. 11 is a top partial view of a plasma display apparatus according to a third embodiment of the present invention.

FIG. 11 is a top view showing in part the construction of a PDP according to a third embodiment of the present invention. Referring to FIG. 11, in the PDP according to the third embodiment, each of the cells 27 is arranged closely to achieve higher density of cells, thereby enhancing brightness of the PDP. The address electrode 22 is arranged so as to extend along left end and right side of the cells of alternately row by row. The cells may be arranged so that a set of R, G, and B cells forms a triangle, i.e., in a delta arrangement, so that interlacing may be used for operation.

Figure 12:
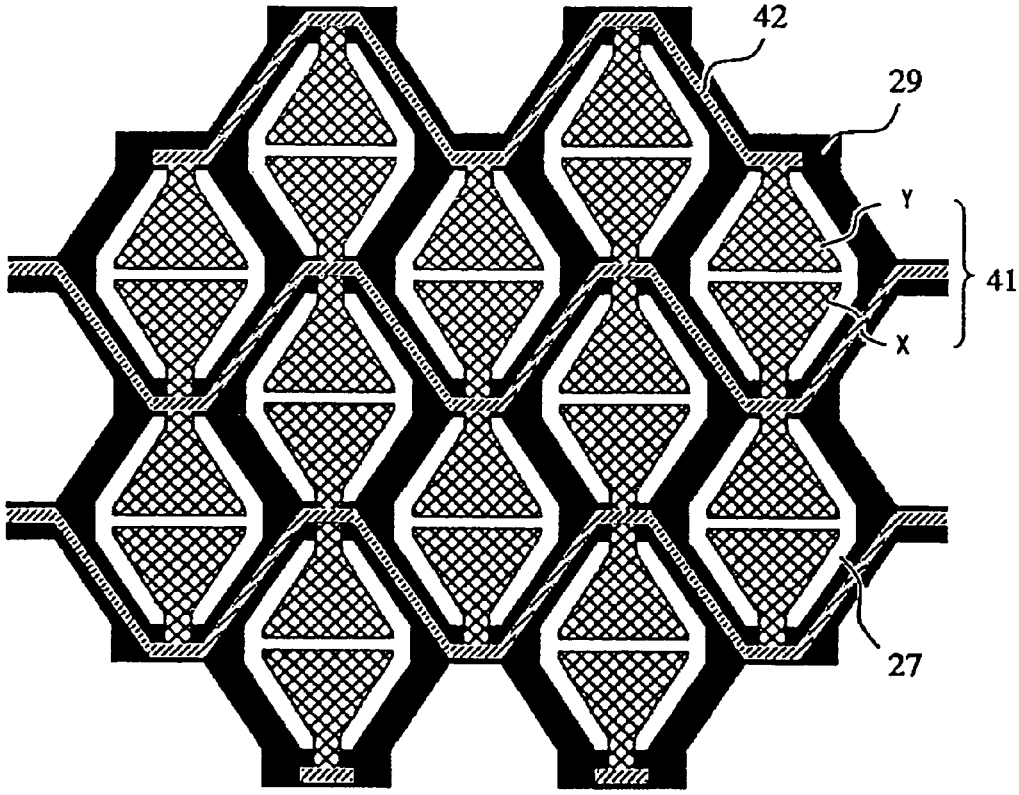
FIG. 12 is a top partial view of a modification of the plasma display apparatus according to the third embodiment.
Figure 13:
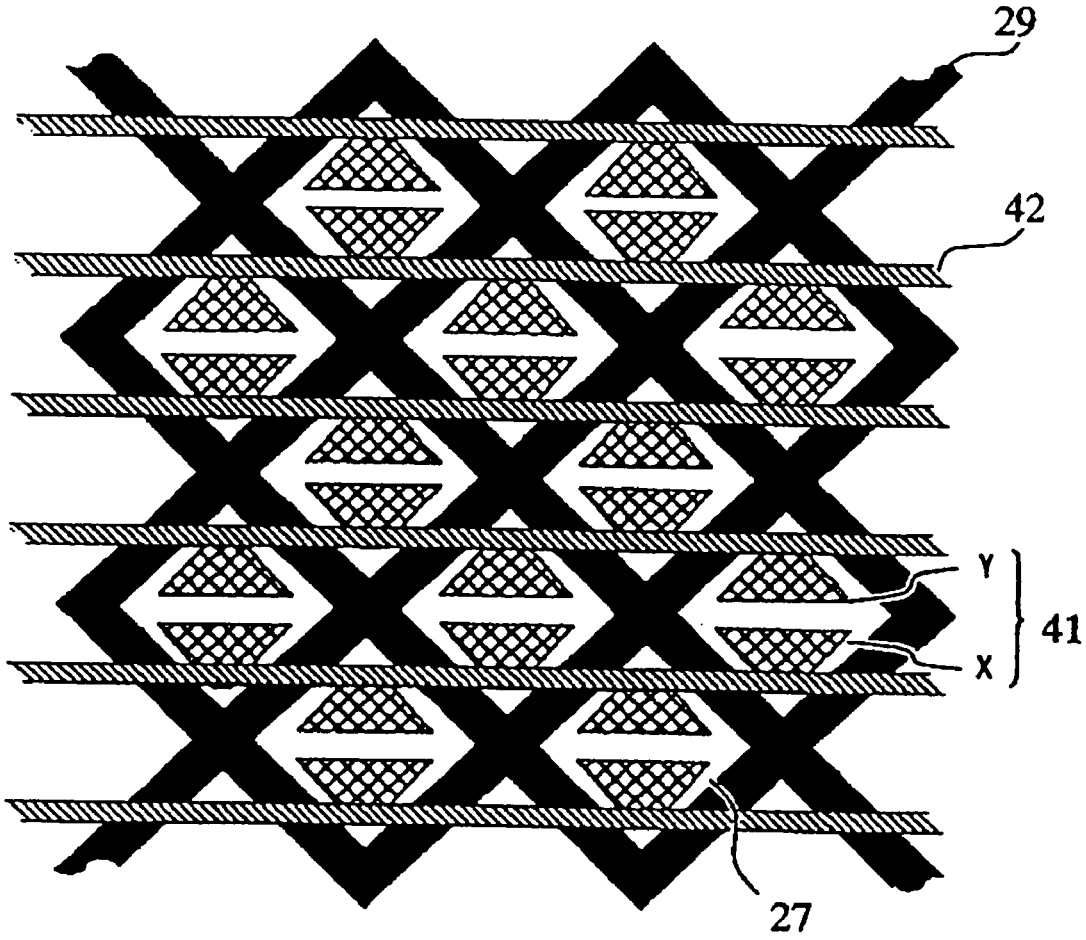
FIG. 13 is a top partial view of another modification of the plasma display apparatus according to the third embodiment.

FIG. 12 and FIG. 13 are top views showing modifications of the third embodiment. In the PDP shown in FIG. 12, the display element electrode 41 is constituted of a pair of substantially triangular electrode segments, and the bus electrode 42 is formed on top of the top surface of the barrier structure 29 so as not to overlap the cells. In the PDP shown in FIG. 13, the display element electrode 41 is constituted of a pair of triangular or trapezoidal electrode segments while the barrier structure 29 being formed in a lattice pattern.

Fourth Embodiment

Figure 14:
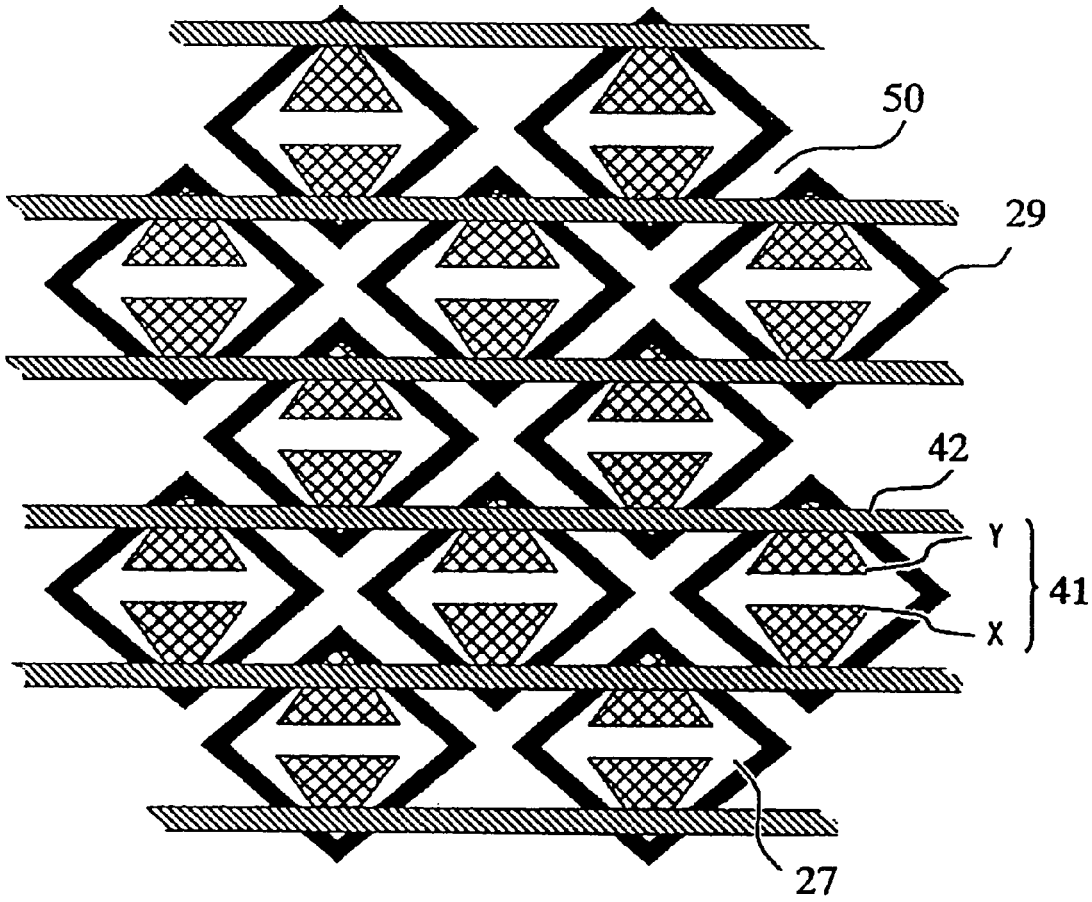
FIG. 14 is a top partial view of a plasma display apparatus according to a fourth embodiment of the present invention.
Figure 15:
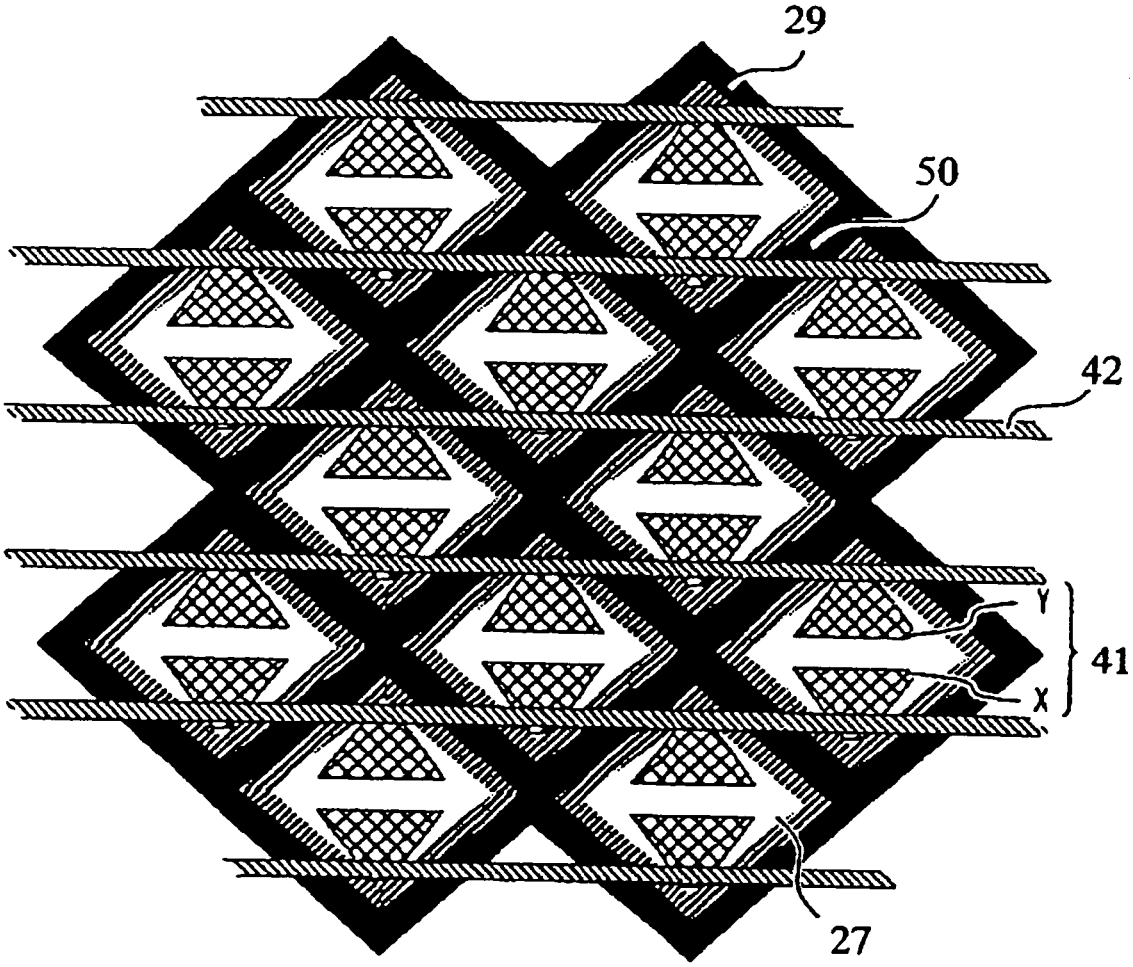
FIG. 15 is a top partial view of a modification of the plasma display apparatus according to the fourth embodiment.

FIG. 14 is a top view showing in part the construction of a PDP according to a fourth embodiment of the present invention. As shown in FIG. 14, the barrier structure 29 includes separate units. Each of the separate units defines the cell 27 and evacuation channel 50. The evacuation channel 50 running in two crossing directions facilitates the evacuation process. FIG. 15 shows a modification of the fourth embodiment, in which the evacuation channel 50 is formed in black so as to enhance contrast.

Figure 9:
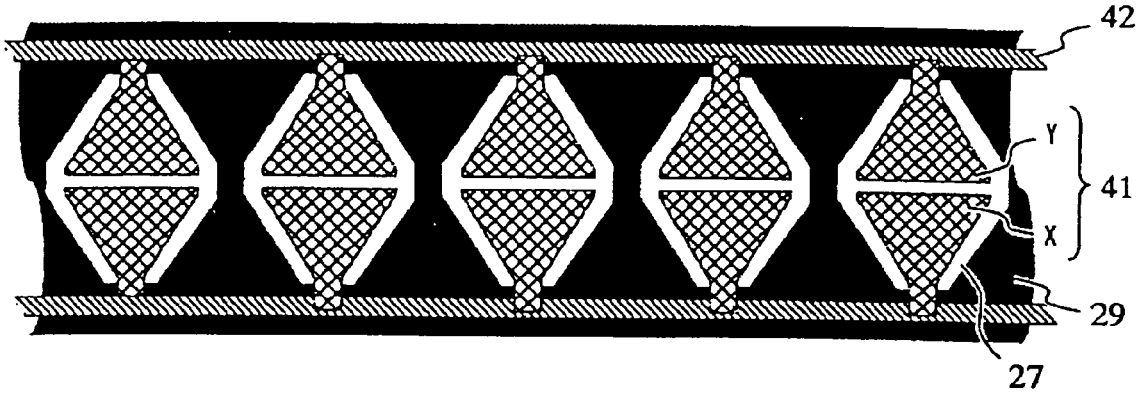
FIG. 9 is top partial view showing a modification of the plasma display apparatus according to the first embodiment, in which a display element electrode is constituted of a pair of triangular electrode segments.

It is to be appreciated that the fourth embodiment may be practiced while forming the cells in elliptical or rhombus shapes as in the PDPs shown in FIG. 6 and FIG. 9, respectively.

Fifth Embodiment

Figure 16A:
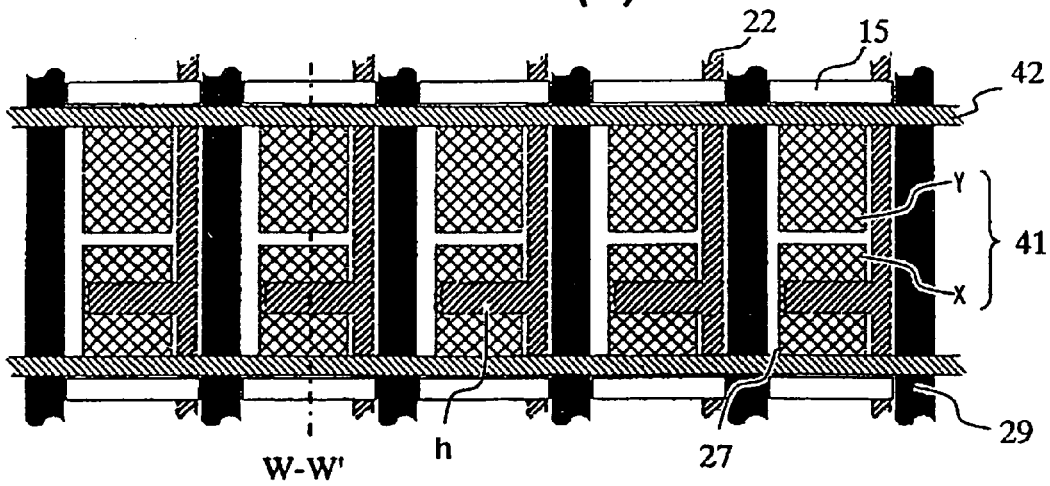
FIGS. 16A and 16B are, respectively, a top partial view and a sectional view of a plasma display apparatus according to a fifth embodiment of the present invention.
Figure 16B:
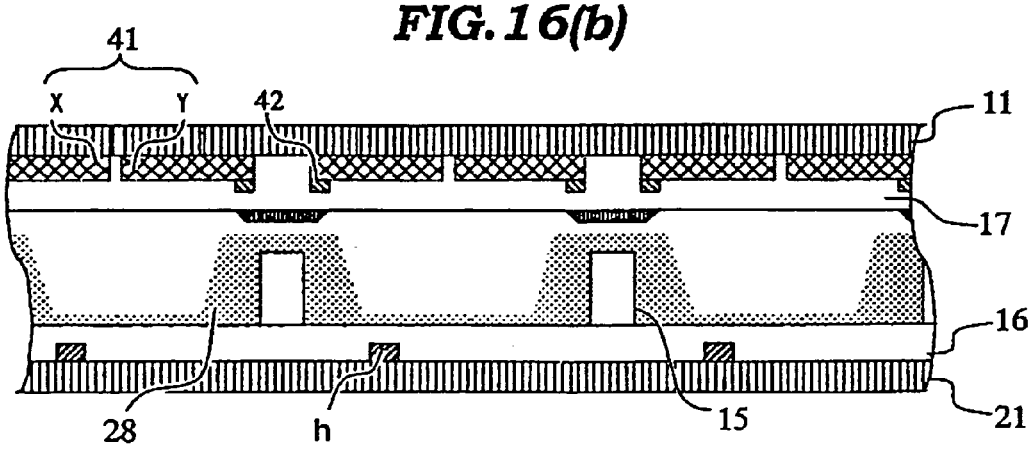

FIG. 16A is a top view showing in part the construction of a PDP according to a fifth embodiment of the present invention, and FIG. 16B is a sectional view taken along the line W-W' in FIG. 16A. The PDP shown in FIGS. 16A and 16B has the display element electrode 41 constituted of a pair of rectangular electrode segments, and rectangular cell 27 defined by the barrier structure 29 and a plurality of dielectric members, one of which is indicated by the reference numeral 15. The inner surface of the cell 27 is coated with the phosphor member 28. The phosphor members over the entire cells are coated continuously in the column direction so as to form stripes pattern. The address electrode 22 disposed along one side of the cells 27 has projecting portions, one of which is indicated by h. Each of the projecting portions is disposed so as to overlap the X electrode segment of the display element electrodes 41, to produce address discharge with the X electrode segments.

Sixth Embodiment

With the address electrode 22 being disposed along one side edge of the associated column of cells, the efficiency of emission of light improved when the distance between the display element electrode 41 and the phosphor member 28 was increased. For example, with the address electrode 22 disposed at the center of the associated column of cells, the brightness becomes maximum when the height of the barrier structure 29 is approximately 150 μm, whereas when the address electrode 22 is disposed along one side end of the associated column of cells, the brightness increased as the height of the barrier structure 29 was increased up to 300 μm. The sealed gas was a mixture of 95% of Ne and 5% of Xe, and the pressure thereof is 66 kPa at room temperature. The discharge gap of the display element electrode 41 was 70 to 100 μm.

However, if the distance between the display element electrode 41 and the phosphor member 28 is increased, the distance between the display element electrode 41 and the address electrode 22 also increases, causing the problem that the breakdown voltage for address discharge is raised. A sixth embodiment of the present invention involves a PDP in which address discharge is readily performed even if the distance between the display element electrode 41 and the address electrode 22 is increased.

Figure 17A:
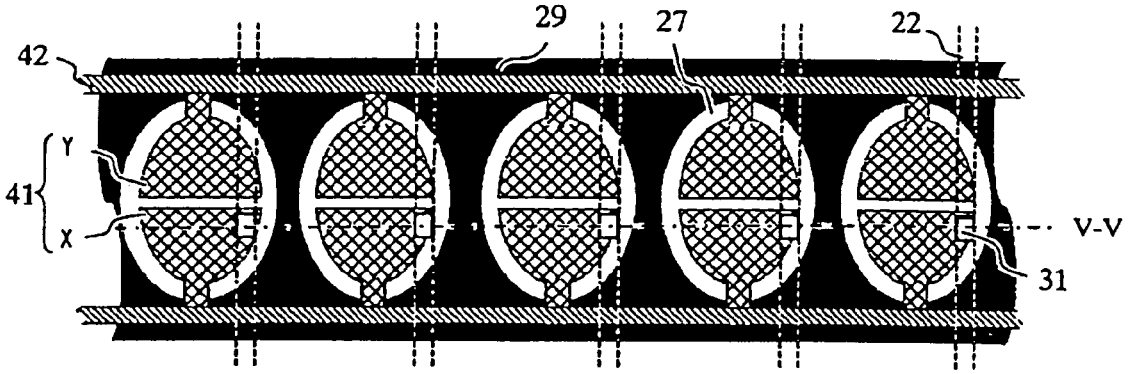
FIGS. 17A and 17B are, respectively, a top partial view and a sectional view of a plasma display apparatus according to a sixth embodiment of the present invention.
Figure 17B:
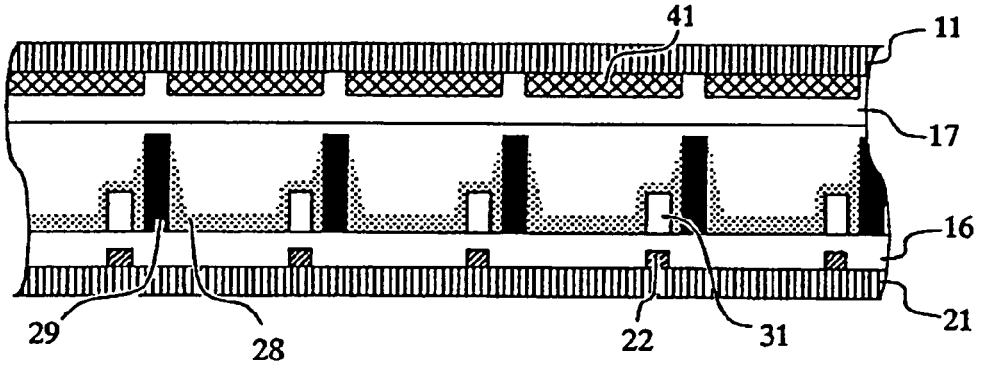

FIG. 17A is a top view showing in part the construction of a PDP according to the sixth embodiment of the present invention, and FIG. 17B is a sectional view taken along the line V–V' in FIG. 17A. Referring to FIGS. 17A and 17B, in the PDP according to the sixth embodiment, a plurality of convex dielectric projections are provided on the address electrodes, one of which is indicated by the reference numeral 31. The top end of each dielectric projection 31 faces the X electrode segment of the display element electrode 41. Because the dielectric projection 31 is provided in between the address electrode 22 and the display element electrode 41, the discharge gap therebetween is effectively reduced, facilitating address discharge. The dielectric projection 31 may be manufactured of the same material as and simultaneously with the barrier structure 29 by, for example, press forming. The dielectric projection 31 may also be formed integrally with the barrier structure 29.

By extending the height of the barrier structure employing the construction as shown in FIGS. 17A and 17B, the efficiency of emission of light by the phosphor member 28 is improved, and the capacitance generated between the display element electrode 41 and the address electrode 22 is reduced. In addition, the construction serves to provide a sufficient distance between the display element electrode 41 and the phosphor member 28, thus inhibiting the problem which otherwise occurs that breakdown voltage differs among phosphor members for different colors.

What is claimed is:

1. A plasma display apparatus comprising:

a plurality of display element electrodes each including a pair of electrode segments with edges opposing each other, separated by a gap of predetermined distance, in which the width of each of the electrode segments narrows continuously across the display element electrode segment beginning at the associated one of the edges and in a direction away from the edges toward a bus electrode to which the display element electrode is connected;

a front substrate on which the plurality of display element electrodes are arranged along a row direction and a column direction;

a barrier structure, the inner surfaces of which being disposed along the outer ends of the plurality of display element electrodes thereby defining the outer shape of a plurality of cells which narrows continuously in a direction away from the edges toward the bus electrode, each of the cells which is coated with a phosphor member and is activated by a discharge of energy from one of the plurality of display element electrodes so as to emit light; and a back substrate disposed opposing the front substrate with, the barrier structure therebetween.

2. A plasma display apparatus according to claim 1, wherein the pair of electrode segments each have a semielliptical or semicircular shape.

3. A plasma display apparatus according to claim 1, wherein the pair of electrode segments each have a triangular or trapezoidal shape.

4. A plasma display apparatus according to claim 1, wherein the barrier structure comprises a plurality of separate units which define each of the plurality of cells so as to provide an evacuation channel structure in between the plurality of separate units.

5. A plasma display apparatus according to claim 1, wherein the width of the barrier structure is varied in accordance with the width of each of the plurality of display element electrodes so as to define a channel passing through the plurality of cells in the column direction.

6. A plasma display apparatus according to claim 1, wherein the pair of electrode segments each have a triangular or trapezoidal shape, and wherein the barrier structure is formed in a lattice pattern as viewed perpendicularly to the front substrate and the back substrate.

7. A plasma display apparatus according to claim 1, further comprising a plurality of address electrodes each locally disposed, with respect to the row direction, from the center of the associated column of the plurality of cells as viewed perpendicularly to the front substrate and the back substrate.

8. A plasma display apparatus according to claim 7, further comprising a plurality of dielectric projections formed on the plurality of address electrodes, each of the plurality of dielectric portions facing predetermined one of the pair of electrode segments constituting the associated one of the plurality of display element electrodes.

9. A plasma display apparatus according to claim 1, wherein each of the plurality of cells is provided with a reflecting layer disposed below the phosphor member.

10. A plasma display apparatus comprising:

a plurality of display element electrodes each including a pair of electrode segments with edges opposing each other, separated by a gap of predetermined distance, each of the electrode segments having a portion where the width continuously narrows across the electrode segment in the direction away from the associated one of the edges toward a bus electrode to which the display element electrode is connected;

a front substrate on which the plurality of display element electrodes are arranged along a row direction and a column direction;

a barrier structure, the inner surface of which being disposed along the outer ends of the plurality of display element electrodes thereby defining the outer ends of a plurality of cells which narrows continuously in a direction away from the edges toward the bus electrode, each of the cells which is one of the plurality of display element electrodes so as to emit light; and a back substrate disposed opposing the front substrate with, the barrier structure therebetween.

* * * * *